US010737488B2

(12) United States Patent
Hiramatsu

(10) Patent No.: US 10,737,488 B2
(45) Date of Patent: Aug. 11, 2020

(54) DROPLET DISCHARGING DEVICE

(71) Applicant: Seiko Epson Corporation, Tokyo (JP)

(72) Inventor: Kazunori Hiramatsu, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/312,232

(22) PCT Filed: May 25, 2017

(86) PCT No.: PCT/JP2017/019567
§ 371 (c)(1),
(2) Date: Dec. 20, 2018

(87) PCT Pub. No.: WO2017/221628
PCT Pub. Date: Dec. 28, 2017

(65) Prior Publication Data

US 2019/0232648 A1 Aug. 1, 2019

(30) Foreign Application Priority Data

Jun. 23, 2016 (JP) ..... 2016-124229

(51) Int. Cl.
*B41J 2/045* (2006.01)
*B41J 2/01* (2006.01)
(Continued)

(52) U.S. Cl.
CPC ..... *B41J 2/04586* (2013.01); *B41J 2/01* (2013.01); *B41J 2/04561* (2013.01); *B41J 2/195* (2013.01); *B41J 29/377* (2013.01); *B41J 29/393* (2013.01)

(58) Field of Classification Search
CPC ..... B41J 2/04586; B41J 2/01; B41J 29/377; B41J 2/195; B41J 2/04561; B41J 29/393; B41J 29/38; B41J 29/02
See application file for complete search history.

(56) References Cited

U.S. PATENT DOCUMENTS

2002/0057312 A1* 5/2002 Watanabe ..... B41J 2/1408 347/56
2013/0057615 A1 3/2013 Torigoe et al.

FOREIGN PATENT DOCUMENTS

EP 2857209 4/2015
JP 9-309200 A 12/1997
(Continued)

OTHER PUBLICATIONS

IP.com search (Year: 2019).*
(Continued)

*Primary Examiner* — Lisa Solomon
(74) *Attorney, Agent, or Firm* — Workman Nydegger

(57) ABSTRACT

Provided is a droplet discharging device capable of, while suppressing influence on a droplet discharge mode of a discharging head, suppressing heat generation of a head driving circuit for driving the discharging head. A printing apparatus (10) (droplet discharging device) includes a discharging head (54) configured to discharge ink, a head driving circuit (56) configured to drive the discharging head (54), a heat dissipation unit (57) configured to dissipate heat generated in the head driving circuit (56), a carriage (52) configured to move in a state of supporting the discharging head (54), the head driving circuit (56), and the heat dissipation unit (57), and at least one air blowing unit (60) disposed outside a movement region of the carriage (52) and capable of generating an airflow toward the heat dissipation unit (57) supported by the carriage (52).

11 Claims, 7 Drawing Sheets

(51) Int. Cl.

| | |
|---|---|
| ***B41J 29/377*** | (2006.01) |
| ***B41J 2/195*** | (2006.01) |
| ***B41J 29/393*** | (2006.01) |

(56) References Cited

FOREIGN PATENT DOCUMENTS

| | | | |
|---|---|---|---|
| JP | 2000-343690 | A | 12/2000 |
| JP | 2002-321343 | A | 11/2002 |
| JP | 2003-220696 | A | 8/2003 |
| JP | 2005-014469 | A | 1/2005 |
| JP | 2006-264328 | A | 5/2006 |
| JP | 2013-120861 | | 6/2013 |
| JP | 2014-144588 | A | 8/2014 |
| WO | 1999/062716 | A1 | 12/1999 |
| WO | 2013/085013 | A1 | 6/2013 |
| WO | 2015/174440 | A1 | 11/2015 |

OTHER PUBLICATIONS

International Search Report cited in PCT/JP2017/019567, dated Jul. 11, 2017.

European Search Report issued in corresponding application No. EP17815097 dated Jan. 6, 2020.

* cited by examiner

DROPLET DISCHARGING DEVICE

TECHNICAL FIELD

The invention relates to a droplet discharging device such as an ink jet printer.

BACKGROUND ART

Traditionally, as an example of a droplet discharging device, a printing apparatus that includes a head (discharging head) for discharging ink and a carriage for moving in a scan direction in a state of supporting the head, and that performs printing by discharging ink toward a medium from the head while moving the carriage in the scan direction has been known.

Additionally, in such a printing apparatus, a head driver integrated circuit (head driving circuit) for driving the head, a heat dissipation unit for dissipating heat generated in the head driver integrated circuit, and a fan (air blowing unit) for cooling the heat dissipation unit are disposed in the carriage (e.g., PTL 1) in some cases.

CITATION LIST

Patent Literature

[PTL 1] JP-A-2013-120861

SUMMARY OF INVENTION

Technical Problem

However, in the above-described printing apparatus, vibration generated along with driving of the fan may be transmitted to the head, thus affecting an ink discharging mode of the head. For example, a landing position of ink discharged from the head to the medium may deviate, deteriorating printing quality.

Note that, the above-described circumstance is generally a common issue, not only in a printing apparatus, but also in a droplet discharging device in which a discharging head for discharging a droplet and a head driving circuit for driving the discharging head are disposed in a carriage.

The invention has been made in view of the above-described circumstances. An advantage of the present invention is to provide a droplet discharging device capable of, while suppressing influence on a droplet discharge mode of a discharging head, suppressing heat generation of a head driving circuit for driving the discharging head.

Solution to Problem

Hereinafter, measures for eliminating the above-described issues and advantages of the measures will be described.

A droplet discharging device for addressing the above-described issues includes a discharging head configured to discharge a droplet toward a medium, a head driving circuit configured to drive the discharging head, a heat dissipation unit configured to dissipate heat generated in the head driving circuit, a carriage configured to move in a state of supporting the discharging head, the head driving circuit, and the heat dissipation unit, and at least one airflow generating unit disposed outside a movement region of the carriage and capable of generating an airflow toward the heat dissipation unit supported by the carriage.

According to the above-described configuration, since an airflow toward the heat dissipation unit is generated by the airflow generating unit, cooling efficiency of the head driving circuit by the heat dissipation unit can be enhanced. Additionally, since the airflow generating unit is disposed outside the movement region of the carriage, vibration generated along with airflow generation is unlikely to be transmitted from the airflow generating unit to the discharging head supported by the carriage. Thus, heat generation of the head driving circuit for driving the discharging head can be suppressed while influence on the droplet discharge mode of the discharging head can be suppressed.

Further, in the above-described droplet discharging device, the movement region includes a droplet discharging region in which a droplet is discharged onto the medium, and a maintenance region for performing maintenance of the discharging head, and at least when the carriage is positioned in the maintenance region, the at least one airflow generating unit is preferably configured to generate an airflow toward the heat dissipation unit supported by the carriage.

According to the above-described configuration, while the maintenance of the discharging head is performed, the head driving circuit can be cooled. Accordingly, for example, under a circumstance in which performing maintenance of the discharging head and cooling the head driving circuit are necessary, downtime in which the discharging head cannot discharge a droplet can be shortened compared to a case in which the maintenance of the discharging head and the cooling of the head driving unit are independently performed.

Further, in the above-described droplet discharging device, the at least one airflow generating unit includes a first airflow generating unit and a second airflow generating unit, and the first airflow generating unit and the second airflow generating unit may desirably be provided along a movement region of the carriage.

According to the above-described configuration, even while the discharging head is discharging a droplet onto the medium, the head driving circuit can be cooled. Additionally, since an airflow is generated in the movement region of the carriage by the airflow generating unit, mist generated along with a droplet discharged by the discharging head can be removed from the movement region of the carriage.

Additionally, in the above-described droplet discharging device, the movement region includes a droplet discharging region in which a droplet is discharged onto the medium, and a maintenance region for performing maintenance of the discharging head. When the first airflow generating unit is configured to generate an airflow toward the heat dissipation unit supported by the carriage positioned in the droplet discharging region and when the second airflow generating unit is configured to generate an airflow toward the heat dissipation unit supported by the carriage positioned in the maintenance region, when the carriage is positioned in the maintenance region, while airflow generation from the first airflow generating unit is preferably limited, airflow generation from the second airflow generating unit is preferably allowed.

According to the above-described configuration, when maintenance of the discharging head is performed, the airflow generation from the second airflow generating unit is allowed, and thus while maintenance of the discharging head is performed, the head driving circuit can be cooled. On the other hand, since the airflow generation from the first airflow generating unit is limited, unnecessary airflow generation from the first airflow generating unit is suppressed while maintenance of the discharging head is performed. Accordingly, while the head driving circuit is cooled, airflow generation from the first airflow generating unit that does not contribute to cooling the head driving circuit can be suppressed.

Additionally, the droplet discharging device may include a temperature detection unit supported by the carriage, and airflow generation from the at least one airflow generating unit may desirably be controlled according to a detected temperature by the temperature detection unit.

According to the above-described configuration, for example, the airflow from the at least one airflow generating unit can be strengthened when the detected temperature is high, and the airflow from the at least one airflow generating unit can be weakened when the detected temperature is low. This can make the at least one airflow generating unit generate an airflow efficiently.

DESCRIPTION OF EMBODIMENTS

One exemplary embodiment of a droplet discharging device will be described below with reference to the accompanying drawings. Note that the droplet discharging device of the exemplary embodiment is an ink jet-type printing apparatus configured to form characters and images by discharging ink as an example of a droplet onto a medium M such as a sheet.

Figure 1:
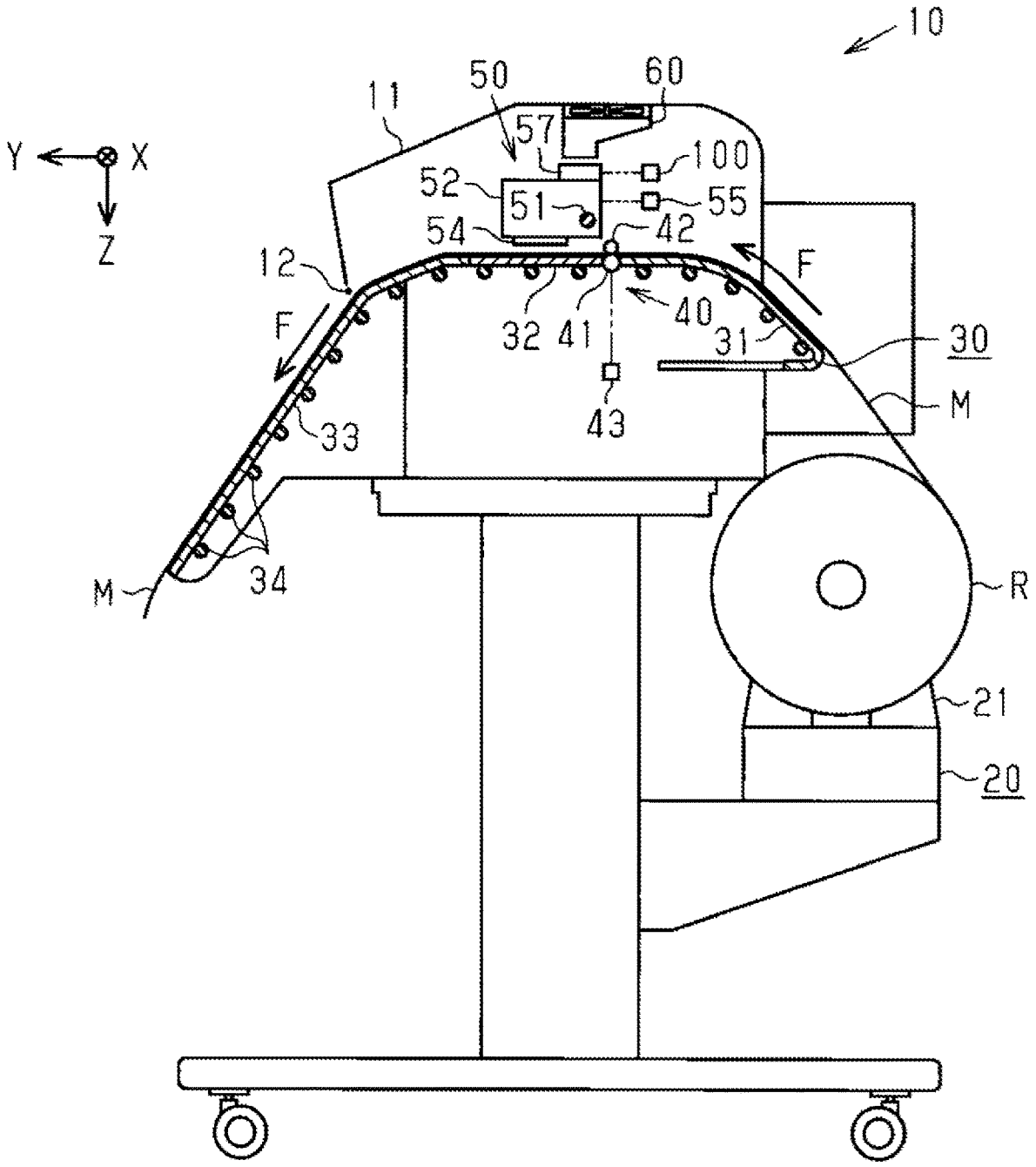
FIG. 1 is a side view of a printing apparatus according to one exemplary embodiment.

As illustrated in FIG. 1, a printing apparatus 10 includes a feeding unit 20 configured to feed the medium M, a support unit 30 configured to support the medium M, a transport unit 40 configured to transport the medium M, a printing unit 50 configured to perform printing on the medium M, at least one air blowing unit 60 configured to blow a gas toward the printing unit 50, and a control unit 100 configured to control these configurations.

Note that, in the following description, a width direction of the printing apparatus 10 is referred to as a "scan direction X", a depth direction of the printing apparatus 10 is referred to as a "front-rear direction Y", a height direction of the printing apparatus 10 is referred to as a "vertical direction Z", and a direction in which the medium M is transported is referred to as a "transport direction F". The scan direction X, the front-rear direction Y, and the vertical direction Z are directions intersecting (orthogonal to) each other, and the transport direction F is a direction intersecting (orthogonal to) the scan direction X.

The feeding unit 20 includes a holding member 21 configured to rotatably hold a roll body R on which the medium M is wound. The holding member 21 holds different types of media M and roll bodies R with different dimensions in the scan direction X. Moreover, the medium M is unwound from the roll body R and fed toward the support unit 30 by rotating the roll body R in one direction (the counter-clockwise direction in FIG. 1) at the feeding unit 20.

The support unit 30 includes a first support unit 31, a second support unit 32, and a third support unit 33 that form a transport path of the medium M from an upstream side of the transport direction toward a downstream side of the transport direction. The first support unit 31 guides the medium M fed from the feeding unit 20 toward the second support unit 32, the second support unit 32 supports the medium M on which printing is to be performed, and the third support unit 33 guides the medium M on which printing has been performed downstream in the transport direction.

Additionally, in the first support unit 31, the second support unit 32, and the third support unit 33, on an opposite side to the transport path of the medium M, a heating unit 34 configured to heat the first support unit 31, the second support unit 32, and the third support unit 33 is provided. The heating unit 34, via the first support unit 31, the second support unit 32, and the third support unit 33, indirectly heats the medium M supported by these support units 31 to 33. Further, the heating unit 34 may be configured with heating wire (heater wire), or the like, for example.

The transport unit 40 includes a transport roller 41 configured to apply a transport force to the medium M, a driven roller 42 configured to press the medium M against the transport roller 41, and a rotation mechanism 43 configured to drive the transport roller 41. The transport roller 41 and the driven roller 42 are rollers with the scan direction X serving as an axis direction. Additionally, the transport roller 41 is disposed vertically below the transport path of the medium M, and the driven roller 42 is disposed vertically above the transport path of the medium M. The rotation mechanism 43 may be configured with a motor and a reduction gear, or the like, for example. Additionally, the transport unit 40 transports the medium M in the transport direction F by rotating the transport roller 41 while the medium M is pinched between the transport roller 41 and the driven roller 42.

Next, the printing unit 50 will be described in detail with reference to FIG. 2 and FIG. 3.

Figure 2:
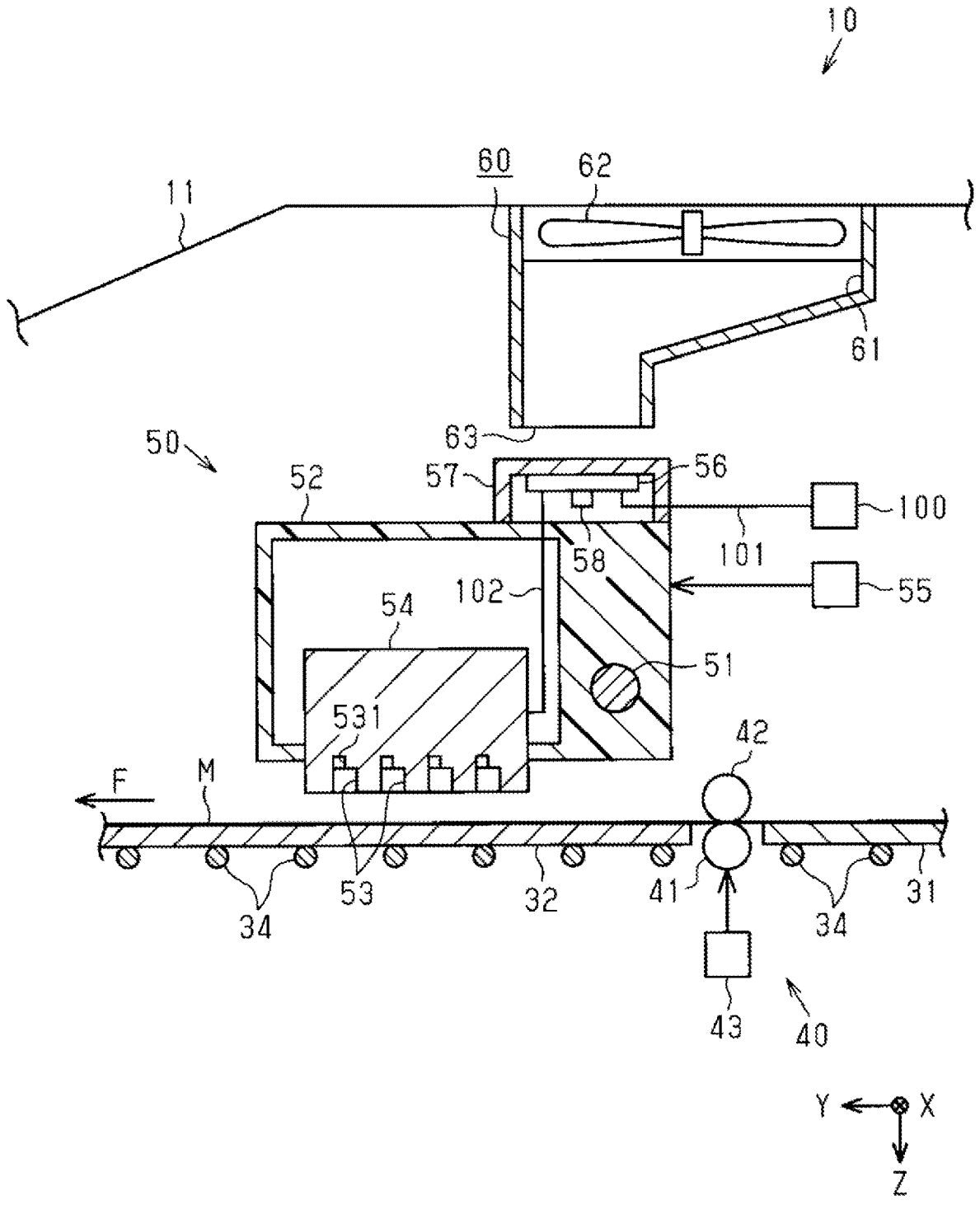
FIG. 2 is a side view of a peripheral configuration of a printing unit of the above-described printing apparatus.
Figure 3:
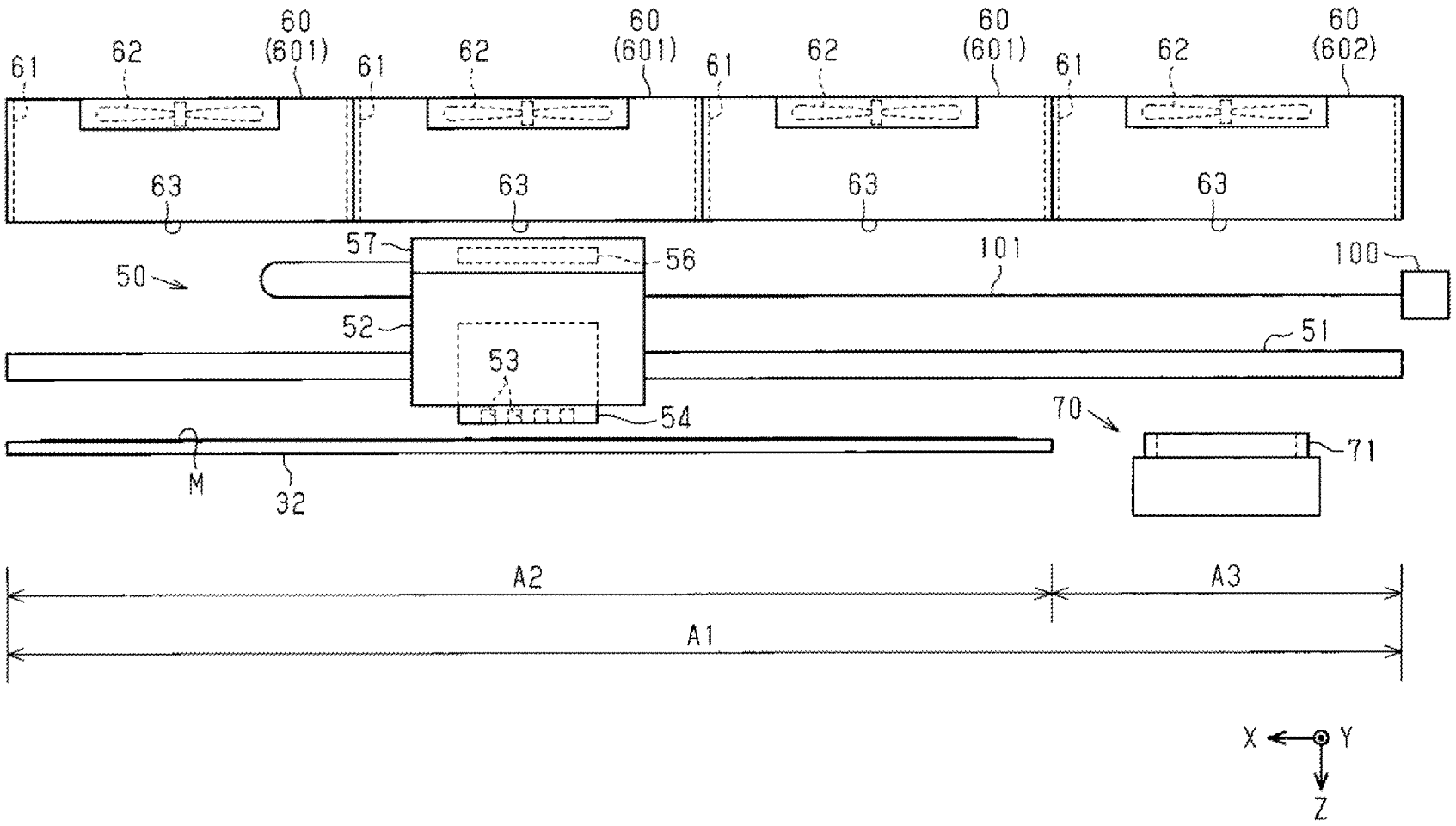
FIG. 3 is a front view of the peripheral configuration of the above-described printing unit.

As illustrated in FIG. 2 and FIG. 3, the printing unit 50 includes a guide shaft 51 with the scan direction X serving as the axis direction, a carriage 52 supported on the guide shaft 51 and movable in the scan direction X, a discharging head 54 including a nozzle 53 configured to discharge ink onto the medium M, and a movement mechanism 55 configured to move the carriage 52 in the scan direction X. Additionally, the printing unit 50 includes a head driving circuit 56 configured to drive the discharging head 54, a heat dissipation unit 57 configured to dissipate heat generated in the head driving circuit 56, a temperature detection unit 58 configured to detect a temperature of the head driving circuit 56, and a maintenance unit 70 configured to perform maintenance of the discharging head 54.

The carriage 52 has a box shape, and a space that accommodates part of the discharging head 54 is formed inside the carriage 52. Further, a vertically lower portion of the carriage 52 supports the discharging head 54, and a vertically upper portion of the carriage 52 supports the head driving circuit 56 and the heat dissipation unit 57.

As illustrated in FIG. 2, the discharging head 54 is a so-called ink jet head in which an actuator 531 such as a piezoelectric element driven to discharge ink is included for each nozzle 53. In the discharging head 54, in a state of being supported by the carriage 52, an opening of the nozzle 53 faces the second support unit 32. Additionally, the movement mechanism 55 is a mechanism that includes a motor and a reduction gear, and converts rotation of the motor into movement in the scan direction X of the carriage 52. Accordingly, in the exemplary embodiment, driving the movement mechanism 55 moves the carriage 52 in the scan direction X.

As illustrated in FIG. 2, the head driving circuit 56 is supported by the carriage 52 via the heat dissipation unit 57. As illustrated in FIG. 2 and FIG. 3, the head driving circuit 56 is coupled with the control unit 100 via a first cable 101, and is coupled with the discharging head 54 via a second cable 102. Here, the first cable 101 is configured to couple the head driving circuit 56 disposed on the carriage 52 reciprocating in the scan direction X and the control unit 100 fixedly disposed inside a housing 11, and thus is preferably a Flexible Flat Cable (FFC) that follows and deforms along with movement of the carriage 52.

As illustrated in FIG. 2, the heat dissipation unit 57 has a substantially box shape, and is disposed vertically above the carriage 52 on a position closer to a rear side of the carriage 52. The head driving circuit 56 is accommodated inside the heat dissipation unit 57 in a state of contact. Additionally, the heat dissipation unit 57 is configured to dissipate heat generated in the head driving circuit 56 outward, and thus is preferably configured as follows.

That is, the heat dissipation unit 57 preferably has a larger contact area with the head driving circuit 56 to increase an amount of transferred heat from the head driving circuit 56. Further, the heat dissipation unit 57 is preferably formed of a metal material having a high heat transfer rate such as aluminum to make it easier to transfer heat from an inside of the heat dissipation unit 57 that contacts the head driving circuit 56 to an outside of the heat dissipation unit 57 that contacts ambient air. Additionally, the heat dissipation unit 57 is preferably provided with a heat dissipation fin on the outside, and preferably has a larger area that contacts the ambient air, in order to increase the amount of dissipated heat to the ambient air.

As illustrated in FIG. 3, the maintenance unit 70 is provided to be adjacent to the second support unit 32 in the scan direction X. The maintenance unit 70 includes a cap 71 configured to perform capping to make a space opened by the nozzle 53 a closed space by contacting the discharging head 54. The capping is performed to suppress drying of the nozzle 53 of the discharging head 54, and is an example of maintenance in the exemplary embodiment.

Additionally, in the following descriptions, as illustrated in FIG. 3, in a movement region A1 of the carriage 52, a region in which the discharging head 54 discharges ink toward the medium M supported by the second support unit 32 is referred to as an "ink discharging region A2", and a region for performing maintenance of the discharging head 54 is referred to as a "maintenance region A3". That is, the ink discharging region A2 is a region in which the carriage 52 is positioned when the discharging head 54 faces the second support unit 32, and is an example of a "droplet discharging region". Additionally, the maintenance region A3 is a region in which the carriage 52 is positioned when the discharging head 54 faces the maintenance unit 70. Note that, in FIG. 3, each of the regions A1 to A3 is illustrated as a one-dimensional length, but actually refers to a three-dimensional space through which the carriage 52 passes during movement.

As illustrated in FIG. 2, the at least one air blowing unit 60 includes a duct 61 that communicates an inside and an outside of the housing 11, and an air blowing fan 62 provided inside the duct 61. The duct 61 includes an air blowing port 63 that opens toward the movement region A1 of the carriage 52. As illustrated in FIG. 2, the air blowing port 63 of the duct 61 is formed to overlap the heat dissipation unit 57 disposed in the carriage 52 in the transport direction F.

Further, as illustrated in FIG. 3, in the exemplary embodiment, a plurality of the air blowing units 60 is disposed outside the movement region A1 of the carriage 52, specifically, vertically above the movement region A1 of the carriage 52 along the movement region A1 (in the scan direction X). Accordingly, the at least one air blowing unit 60 in the exemplary embodiment can blow a gas toward the entire movement region A1 of the carriage 52. That is, the at least one air blowing unit 60 is disposed along a movement path of the carriage 52, and can blow a gas toward the carriage 52 and the movement path of the carriage 52.

Additionally, in the following descriptions, as illustrated in FIG. 3, among the plurality of the air blowing units 60, an air blowing unit 60 disposed vertically above the ink discharging region A2 is also referred to as a "first air blowing unit 601", and an air blowing unit 60 disposed vertically above the maintenance region A3 is also referred to as a "second air blowing unit 602". In other words, the at least one air blowing unit 60 includes the first air blowing unit 601 and the second air blowing unit 602. In addition, the first air blowing unit 601 and the second air blowing unit 602 are disposed along a movement path of the carriage 52. Further, driving the air blowing fan 62 of the first air blowing unit 601 to generate an airflow from the first air blowing unit 601 is also simply referred to as "driving the first air blowing unit 601", and driving the air blowing fan 62 of the second air blowing unit 602 to generate an airflow from the second air blowing unit 602 is also simply referred to as "driving the second air blowing unit 602".

Additionally, the first air blowing unit 601 is configured to blow a gas toward the ink discharging region A2, and generates an airflow toward the heat dissipation unit 57 of the carriage 52 positioned in the ink discharging region A2. In this regard, in the exemplary embodiment, the first air blowing unit 601 corresponds to an example of the "first airflow generating unit". Additionally, the second air blowing unit 602 is configured to blow a gas toward the maintenance region A3, and generates an airflow toward the heat dissipation unit 57 of the carriage 52 positioned in the maintenance region A3. In this regard, the second air blowing unit 602 corresponds to an example of the "second airflow generating unit".

Additionally, in a region in which the carriage 52 is not positioned in the movement region A1 of the carriage 52, the at least one air blowing unit 60 blows a gas, and thus ink mist, a fragment of the medium M (e.g., paper powder), or the like, floating in the region, is discharged outside the housing 11 via a discharging port 12 by the airflow from the at least one air blowing unit 60. Accordingly, adhesion of the ink mist and the fragments of the medium M on the carriage 52 moving in the movement region A1 can be reduced, and for example, occurrence of defects in ink discharging from the nozzle 53 due to the adhesion of the ink mist and the fragments of the medium M on a vicinity of the nozzle 53 can be reduced.

Further, in a region in which the carriage 52 is positioned in the movement region A1 of the carriage 52, since the gas blown from the at least one air blowing unit 60 hits the heat dissipation unit 57 disposed on the carriage 52, the heat dissipation unit 57 and the head driving circuit 56 are cooled. That is, the airflow toward the heat dissipation unit 57 supported by the carriage 52 cools the heat dissipation unit 57 and the head driving circuit 56.

Next, a control configuration of the printing apparatus 10 will be described with reference to FIG. 4.

Figure 4:
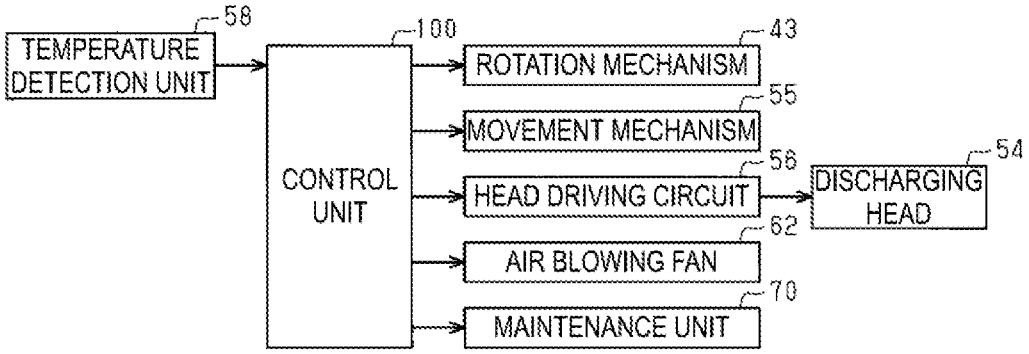
FIG. 4 is a block diagram illustrating an electrical configuration of a control unit of the above-described printing apparatus.

As illustrated in FIG. 4, an input side interface of the control unit 100 is coupled with the temperature detection unit 58 configured to detect a temperature of the head driving circuit 56. On the other hand, an output side interface of the control unit 100 is coupled with the rotation mechanism 43, the movement mechanism 55, the head driving circuit 56, the air blowing fan 62, and the maintenance unit 70.

Additionally, when a print job is inputted from a terminal, which is not illustrated, the control unit 100 controls driving of each configuration to print on the medium M. That is, the control unit 100 alternately performs a transport operation, in which the transport unit 40 transports the medium M by a unit transport amount in the transport direction F, and a discharging operation, in which ink is discharged from the discharging head 54 while the carriage 52 is moved in the scan direction X, to perform printing on the medium M. Additionally, the control unit 100, when printing on the medium M is performed, drives the at least one air blowing unit 60 to blow a gas toward the movement region A1 of the carriage 52.

Note that, the control unit 100, when making the printing unit 50 perform the discharging operation, makes the discharging head 54 discharge ink via the head driving circuit 56. That is, the control unit 100 outputs a control waveform to control a shape of a driving waveform outputted from the head driving circuit 56, timing of outputting the driving waveform, or the like. Additionally, the head driving circuit 56 inputs a driving waveform according to the control waveform to the actuator 531 to make the nozzle 53 corresponding to the actuator 531 discharge ink. For example, the head driving circuit 56, when discharging a large ink droplet from the nozzle 53 is desired, inputs a driving waveform with large amplitude to the actuator 531, and when discharging a small ink droplet from the nozzle 53 is desired, inputs a driving waveform with small amplitude to the actuator 531.

In the printing apparatus 10 in which the head driving circuit 56 configured to drive the discharging head 54 is disposed on the carriage 52, due to heat generated in the head driving circuit 56, a temperature of the head driving circuit 56 and a temperature of the discharging head 54 may rise in some cases. Thus, an air blowing fan for blowing air toward the head driving circuit 56 in order to cool the head driving circuit 56 may be disposed on the carriage 52, but in this case, vibration of the carriage 52 along with driving of the air blowing fan may deteriorate ink discharging performance of the discharging head 54.

Accordingly, in the exemplary embodiment, the heat dissipation unit 57 for cooling the head driving circuit 56 is provided on the carriage 52, and thus an airflow for discharging the ink mist, the fragments of the medium M, or the like, hits the heat dissipation unit 57. Accordingly, without providing the at least one air blowing unit 60 on the carriage 52, a gas can be blown toward the heat dissipation unit 57, and thus heat generation from the head driving circuit 56 can be suppressed while transmission of vibration to the discharging head 54 can be suppressed.

Meanwhile, transmission of heat generated in the head driving circuit 56 to the discharging head 54 can be suppressed in a case where the head driving circuit 56 is disposed outside the carriage 52, but in this case, the following issue may occur due to the fact that the second cable 102 coupling the discharging head 54 and the head driving circuit 56 is lengthened.

That is, since the second cable 102 coupling the head driving circuit 56 and the discharging head 54 is lengthened, inductance of the second cable 102 increases, and a driving waveform is likely to distort. Since the driving waveform directly decides an operation of the actuator 531, the distortion of the driving waveform may affect the size of ink discharged from the discharging head 54, discharging timing of the ink, or the like, deteriorating printing quality.

Additionally, in the discharging head 54 of recent years, along with high functionality, an absolute value of a current flowing in the second cable 102 is likely to increase, and the current is likely to change greatly in a short period of time. Further, the number of the discharging heads 54 tends to be increased in order to improve printing speed, and the number of the actuators 531 also increases accordingly. Thus, the absolute value of the current flowing in the second cable 102 also increases. Thus, when the inductance of the second cable 102 increases, a counter electromotive force generated in the second cable 102 further increases, so the driving waveform is further likely to distort.

Incidentally, since a waveform outputted from the control unit 100 (control circuit) to the head driving circuit 56 is a control waveform for controlling the head driving circuit 56, even when the first cable 101 coupling the control unit 100 and the head driving circuit 56 is lengthened, the influence is relatively small.

Next, with reference to a flowchart illustrated in FIG. 5, processing contents in which the control unit 100 changes a driving mode of the at least one air blowing unit 60 in response to a position of the carriage 52 in the scan direction X will be described.

Figure 5:
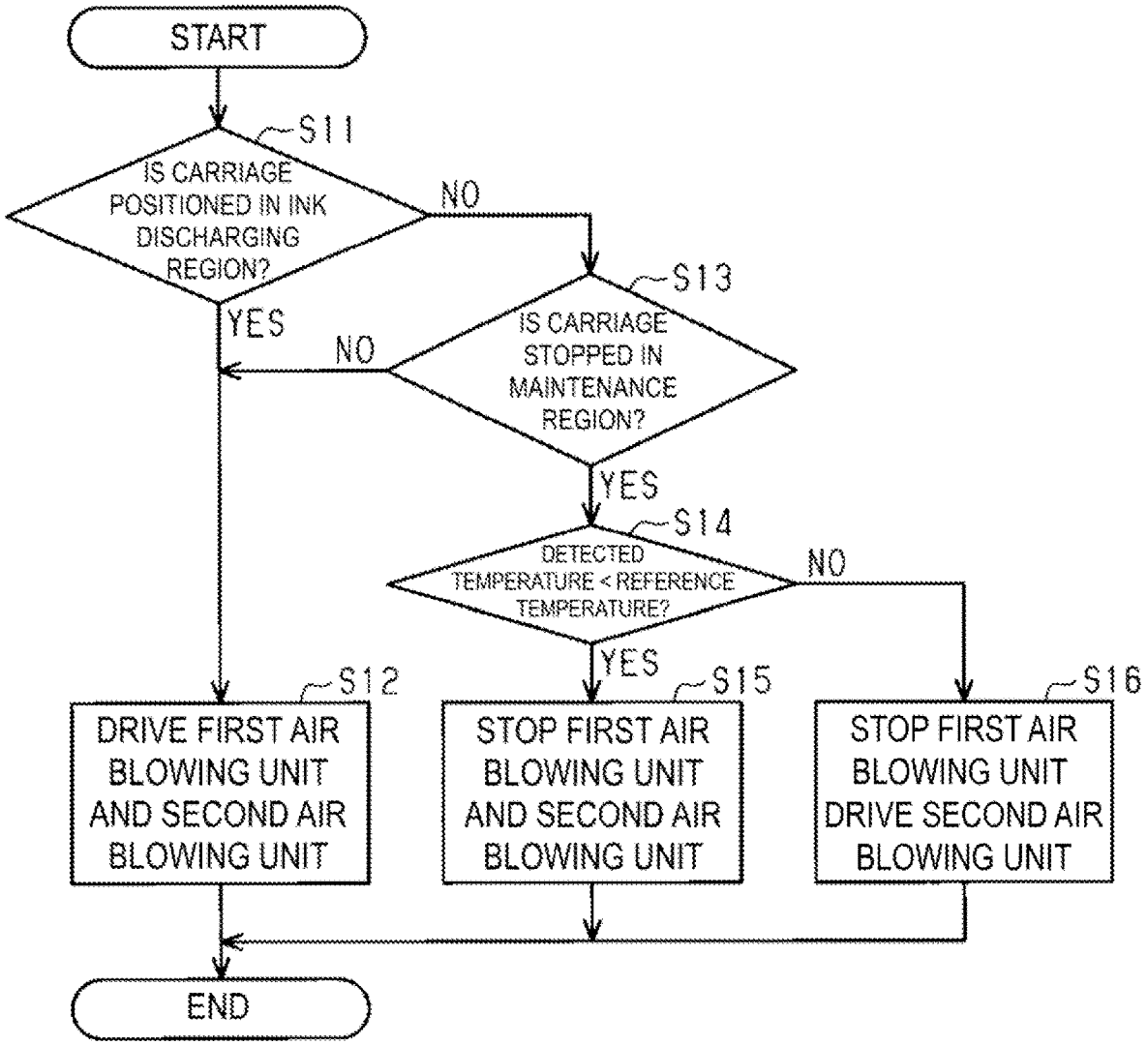
FIG. 5 is a flowchart illustrating a processing flow performed by the above-described control unit in order to decide respective driving modes of a first air blowing unit and a second air blowing unit.

As illustrated in FIG. 5, the control unit 100 determines whether the carriage 52 is positioned in the ink discharging region A2 (step S11), and in a case where the carriage 52 is positioned in the ink discharging region A2 (step S11: YES), the control unit 100 puts the first air blowing unit 601 and the second air blowing unit 602 into a driving state (step S12). That is, driving the first air blowing unit 601 and the second air blowing unit 602 discharges suspended matter such as the ink mist and the fragments of the medium M to the outside of the housing 11, or cools the heat dissipation unit 57 (head driving circuit 56). Subsequently, the control unit 100 temporarily terminates the series of processing.

On the other hand, in the above step S11, in a case where the carriage 52 is positioned in the maintenance region A3 (step S11: NO), the control unit 100 determines whether the carriage 52 stops in the maintenance region A3 (step S13). Additionally, in a case where the carriage 52 does not stop in the maintenance region A3 (step S13: NO), the control unit 100 proceeds the processing to the next step S12. That is, the above case is a case where a state, in which the first air blowing unit 601 and the second air blowing unit 602 are driven, needs to continue since the carriage 52 possibly moves from the maintenance region A3 to the ink discharging region A2.

On the other hand, in a case where the carriage 52 stops in the maintenance region A3 (step S13: YES), the control unit 100, based on a detection result of the temperature detection unit 58, acquires a detected temperature being the temperature of the head driving circuit 56, and determines whether the detected temperature is lower than a reference temperature (step S14). Here, the reference temperature is a determination value for determining whether cooling the head driving circuit 56 is necessary.

Additionally, in a case where the detected temperature is lower than the reference temperature (step S14: YES), the control unit 100 puts the first air blowing unit 601 and the second air blowing unit 602 into a stop state (step S15). That is, in this case, cooling the head driving circuit 56 is not necessary, and thus by putting the first air blowing unit 601 and the second air blowing unit 602 into the stop state, power consumption and noise along with driving of the first air blowing unit 601 and the second air blowing unit 602 are suppressed. Subsequently, the control unit 100 temporarily terminates the series of processing.

On the other hand, in a case where the detected temperature is equal to or higher than the reference temperature (step S14: NO), the control unit 100 puts the first air blowing unit 601 into the stop state, and on the other hand puts the second air blowing unit 602 into the driving state (step S16). That is, in this case, cooling the head driving circuit 56 is necessary, but since the carriage 52 provided with the head driving circuit 56 is positioned in the maintenance region A3, driving the first air blowing unit 601 to cool the head driving circuit 56 is not necessary. Accordingly, the power consumption and the noise along with the driving of the first air blowing unit 601 are suppressed. Subsequently, the control unit 100 temporarily terminates the series of processing.

Note that, in the above described processing contents, in the case where the carriage 52 stops in the maintenance region A3, the first air blowing unit 601 is stopped regardless of the detected temperature, and the second air blowing unit 602 is driven or stopped according to the detected temperature. In this regard, it can be said that in the case where the carriage 52 is positioned in the maintenance region A3, the driving of the first air blowing unit 601 is limited, and airflow generation from the second air blowing unit 602 is allowed.

Additionally, in step S13, in the exemplary embodiment, it can be said that the airflow generation from the second air blowing unit 602 is controlled according to the detected temperature in the temperature detection unit 58 in that a driving mode of the second air blowing unit 602 is changed according to the detected temperature in the temperature detection unit 58.

Next, operation of the printing apparatus 10 in the exemplary embodiment will be described with reference to FIG. 6 and FIG. 7. Note that, in FIG. 6 and FIG. 7, a flow of a gas blown from the at least one air blowing unit 60 is illustrated by a white arrow.

Figure 6:
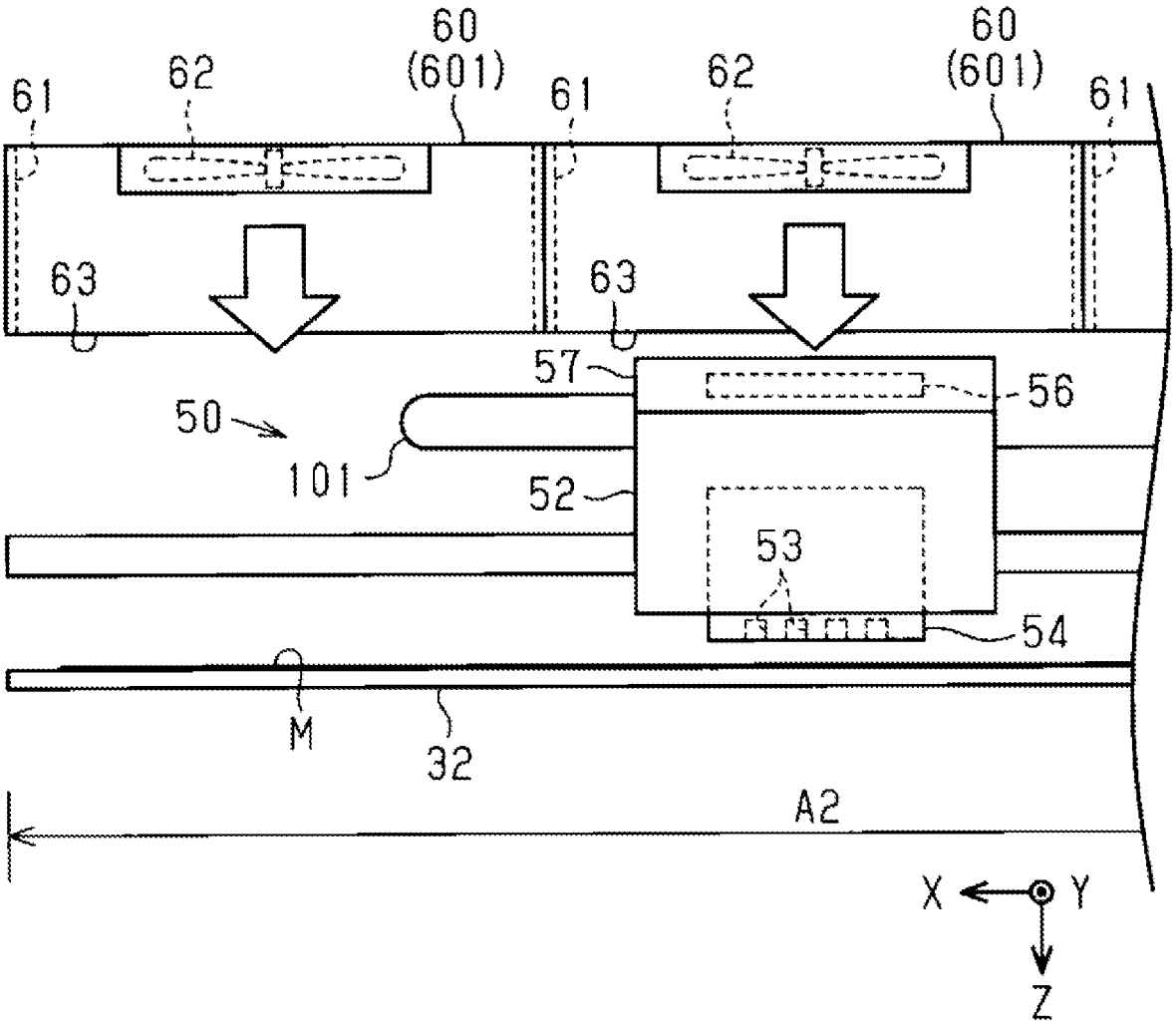
FIG. 6 is a partial front view of the peripheral configuration of the above-described printing unit during printing.

As illustrated in FIG. 6, when printing is performed in the printing apparatus 10, while the carriage 52 is moving in the ink discharging region A2 in the scan direction X, ink is discharged from the discharging head 54 supported by the carriage 52 toward the medium M supported by the second support unit 32. Accordingly, when the printing is performed, the head driving circuit 56 driving the discharging head 54 generates heat.

In this regard, according to the exemplary embodiment, in a case where the carriage 52 reciprocates in the ink discharging region A2 in the scan direction X in order to print, a gas blown from the at least one air blowing unit 60 (first air blowing unit 601) disposed above the ink discharging region A2 hits the heat dissipation unit 57. Thus, the heat generated in the head driving circuit 56 is dissipated via the heat dissipation unit 57, and temperature rise of the head driving circuit 56 is suppressed. Additionally, in the exemplary embodiment, since the at least one air blowing unit 60 is provided across the movement region A1 of the carriage 52, regardless of a position in the ink discharging region A2 in which the carriage 52 is printing, a state where a gas is blown to the heat dissipation unit 57 continues.

Figure 7:
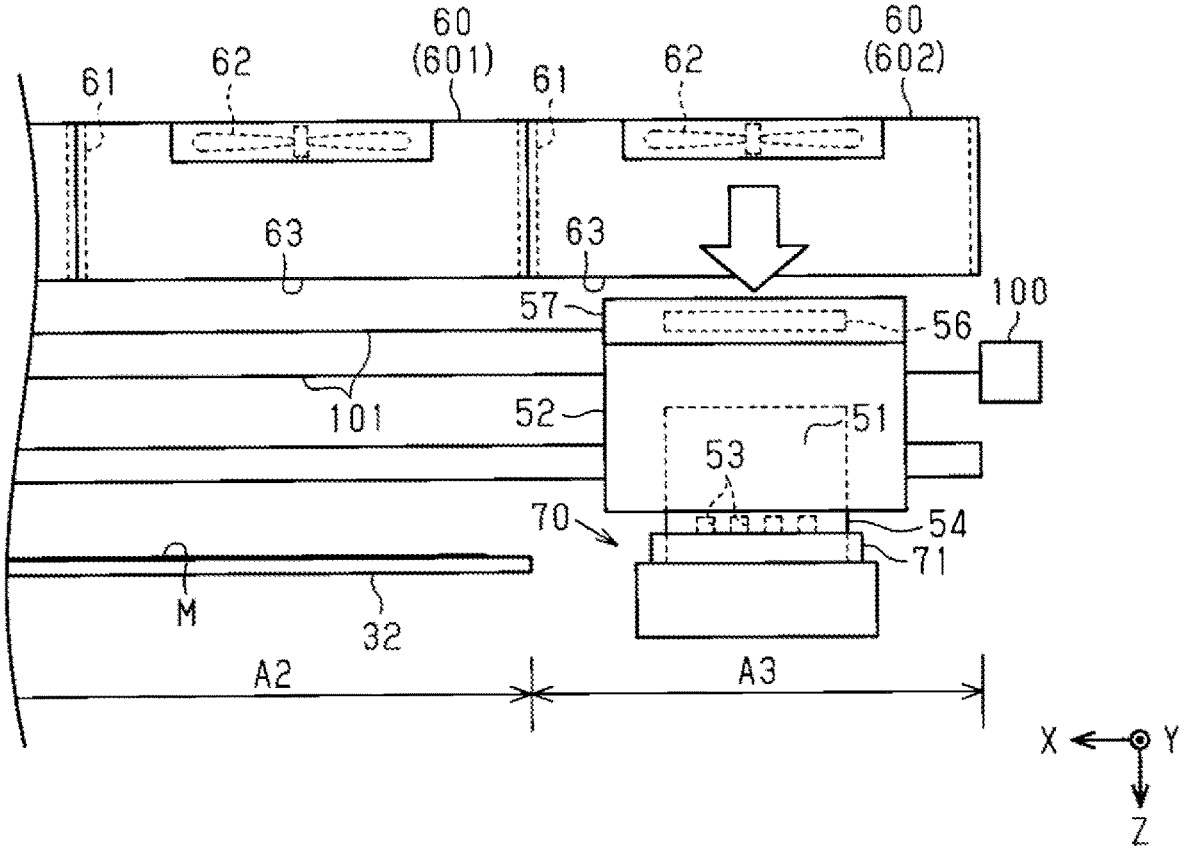
FIG. 7 is a partial front view of the peripheral configuration of the above-described printing unit during maintenance.

Meanwhile, as illustrated in FIG. 7, in the case where the carriage 52 stops in the maintenance region A3 in order to perform the maintenance of the discharging head 54, the gas blown from the air blowing unit 60 disposed vertically above the maintenance region A3 hits the heat dissipation unit 57, and thus the head driving circuit 56 is cooled via the heat dissipation unit 57. Additionally, in the exemplary embodiment, in the case where the carriage 52 stops in the maintenance region A3, the driving of the first air blowing unit 601 disposed vertically above the ink discharging region A2 is stopped. Further, even in the case where the carriage 52 stops in the maintenance region A3, in a case where the temperature of the head driving circuit 56 is lower than a temperature that does not need cooling (the reference temperature), the driving of the second air blowing unit 602 is also stopped.

According to the exemplary embodiments described above, the following advantages are obtained.

(1) The heat dissipation unit 57 configured to dissipate heat generated in the head driving circuit 56 is provided vertically above the carriage 52 such that a gas is blown from the at least one air blowing unit 60 toward the heat dissipation unit 57. Accordingly, due to heat transfer with the gas blown from the at least one air blowing unit 60, cooling efficiency of the head driving circuit 56 by the heat dissipation unit 57 can be enhanced. Additionally, since the at least one air blowing unit 60 is disposed outside the movement region A1 of the carriage 52, vibration along with airflow generation is unlikely to be transmitted from the at least one air blowing unit 60 to the discharging head 54 supported by the carriage 52. Thus, heat generation of the head driving circuit 56 for driving the discharging head 54 can be suppressed while influence on an ink discharge mode of the discharging head 54 can be suppressed.

(2) Since the second air blowing unit 602 is provided vertically above the maintenance region A3, while maintenance of the discharging head 54 is performed, the head driving circuit 56 can be cooled. Accordingly, for example, under a circumstance in which the maintenance of the discharging head 54 and the cooling of the head driving circuit 56 need to be performed, downtime in which the discharging head 54 cannot discharge ink onto the medium M can be shortened compared to a case in which the maintenance of the discharging head 54 and the cooling of the head driving circuit 56 are independently performed.

(3) Since the plurality of the air blowing units 60 is provided along the movement region A1 (in the scan direction X), even while the discharging head 54 is discharging ink onto the medium M, the head driving circuit 56 can be cooled. Additionally, since an airflow is generated in the movement region A1 of the carriage 52 by the at least one air blowing unit 60, mist generated along with ink discharged by the discharging head 54 can be removed from the movement region A1 of the carriage 52.

(4) In the case where the maintenance of the discharging head 54 is performed, while the second air blowing unit 602 for blowing air toward the maintenance region A3 is put into the driving state (an airflow generating state), the first air blowing unit 601 for blowing an air toward the ink discharging region A2 is put into the stop state. Accordingly, in the case where the maintenance of the discharging head 54 is performed, airflow generation from the first air blowing unit 601 that does not contribute to the cooling of the head driving circuit 56 can be suppressed, to reduce power consumption and noise along with airflow generation from the first air blowing unit 601.

(5) Depending on whether the detected temperature of the head driving circuit 56 is lower than the reference temperature, the driving state (airflow generating state) of the second air blowing unit 602 is switched. Thus, in a case where the cooling of the head driving circuit 56 is necessary, since the airflow from the second air blowing unit 602 is generated, an airflow can be generated efficiently from the at least one air blowing unit 60.

Note that the above-described exemplary embodiments may be modified as follows.

The maintenance unit 70 may perform maintenance other than the capping. For example, the maintenance unit 70 may include a wiper and perform wiping on a nozzle formation surface on which the nozzle 53 of the discharging head 54 is formed. Additionally, the maintenance unit 70 may include a decompression unit for reducing pressure inside the cap 71 and perform cleaning in which ink is forcibly discharged from the nozzle 53 of the discharging head 54 by reducing the pressure inside the cap 71 after the capping. Further, the maintenance unit 70 may include a flushing box having an opening portion vertically upward, and accommodate ink, discharged from the discharging head 54 irrelevant to printing, in the flushing box. That is, the maintenance unit 70 may be the maintenance unit 70 that performs the above-described maintenance. Further, the maintenance unit 70 may detect discharge position precision, a discharge amount, presence/absence of discharge, or the like, of the discharging head 54, in order to confirm whether to perform the wiping or the cleaning.

In a case where maintenance in which the discharging head 54 discharges ink is performed, since the head driving circuit 56 drives the actuator 531, even in the case where the carriage 52 is positioned in the maintenance region A3, the head driving circuit 56 generates heat in some cases. Even in this case, the heat generation in the head driving circuit 56 can be suppressed by driving the second air blowing unit 602.

The maintenance unit 70 may not necessarily be provided in the maintenance region A3. In a case where the carriage 52 stops in the maintenance region A3 to wait for printing, or in a case where the carriage 52 moves in the maintenance region A3, the head driving circuit 56 can be cooled by making the second air blowing unit 602 generate an airflow.

An airflow direction of the at least one air blowing unit 60 may not necessarily be vertically downward. For example, air may be blown toward the carriage 52 (heat dissipation unit 57) from at least one air blowing unit 60 provided backward the housing 11.

As for the at least one air blowing unit 60, various configurations that can generate an airflow other than the air blowing fan 62 are adoptable. For example, a configuration in which an airflow is generated by receiving pressurized gas and the like supplied from an outside of the printing apparatus 10, and delivering the gas from the at least one air blowing unit 60 to an inside of the printing apparatus 10 may be used. In this case, by providing an opening/closing unit and the like in the at least one air blowing unit 60, generation and stoppage of an airflow, or an amount of the airflow, may be controllable.

Additionally, the at least one air blowing unit 60 may be a suction unit such as a suction pump configured to suction a gas. For example, a suction unit configured to suction a gas from an inside of the housing 11 may be provided at the discharging port 12 and the suction unit may be driven to generate an airflow toward the heat dissipation unit 57 supported by the carriage 52. That is, in this case, the suction unit corresponds to an example of the "airflow generating unit".

The heat dissipation unit 57 may not necessarily be one that cools only the head driving circuit 56. For example, the heat dissipation unit 57 may be one that cools the discharging head 54.

A shape and a material of the heat dissipation unit 57 may be appropriately changed as long as heat can be dissipated from the head driving circuit 56.

In step S12, the second air blowing unit 602 may be stopped. That is, in the case where the carriage 52 is positioned in the ink discharging region A2, the second air blowing unit 602 may be stopped to suppress the power consumption and the noise along with the driving of the second air blowing unit 602.

In steps S15, S16, the first air blowing unit 601 may be in the driving state. That is, even in the case where the carriage 52 stops in the maintenance region A3, the first air blowing unit 601 may be driven.

Steps S14, S15 may be omitted. That is, in a case where the carriage 52 stops in the maintenance region A3, the second air blowing unit 602 may be in the driving state regardless of the detected temperature. That is, in this case, at least when the carriage 52 is positioned in the maintenance region A3, the second air blowing unit 602 generates an airflow toward the heat dissipation unit 57 supported by the carriage 52.

Respective driving modes of the first air blowing unit 601 and the second air blowing unit 602 may be identical. That is, regardless of a position of the carriage 52 in the movement region A1, the first air blowing unit 601 and the second air blowing unit 602 may be driven constantly.

When both the first air blowing unit 601 and the second air blowing unit 602 are driven, the first air blowing unit 601 may be driven more strongly, or weakly than the second air blowing unit 602.

When a difference between the detected temperature by the temperature detection unit 58 and the reference temperature is large, the second air blowing unit 602 may be driven more strongly compared to a case where the difference is small. According to the above configuration, when the head driving circuit 56 is strongly cooled, the second air blowing unit 602 can be strongly driven, and when the head driving circuit 56 need not be cooled, the second air blowing unit 602 can be weakly driven.

The temperature detection unit 58 may not necessarily be provided on the head driving circuit 56, as long as the temperature detection unit 58 is provided on or in the carriage 52. Alternatively, the temperature detection unit 58 may not necessarily be provided on or in the carriage 52, as long as the temperature detection unit 58 can be provided in a region in which temperature rises in response to the heat generation of the head driving circuit 56.

The medium M may be fiber, leather, plastic, wood, and ceramics, besides a sheet.

The medium M may be, besides the medium M unwound from the roll body R, a medium M having a single sheet-style, or a medium M simply having a long length.

The droplet discharged or ejected from the discharging head 54 is not limited to ink, for example, but may be a liquid material or the like obtained by dispersing or mixing particles of functional materials in liquid. For example, a configuration may be adopted in which a liquid material including a material such as an electrode material and a color material (pixel material) used in the manufacture of liquid crystal displays, electroluminescent (EL) displays, surface emitting displays, and the like in a dispersed or dissolved form is discharged to record.

REFERENCE SIGNS LIST

10 . . . Printing apparatus (example of droplet discharging device), 11 . . . Housing, 12 . . . Discharging port, 20 . . . Feeding unit, 21 . . . Holding member, 30 . . . Support unit, 31 . . . First support unit, 32 . . . Second support unit, 33 . . . Third support unit, 34 . . . Heating unit, 40 . . . Transport unit, 41 . . . Transport roller, 42 . . . Driven roller, 43 . . . Rotation mechanism, 50 . . . Printing unit, 51 . . . Guide shaft, 52 . . . Carriage, 53 . . . Nozzle, 531 . . . Actuator, 54 . . . Discharging head, 55 . . . Movement mechanism, 56 . . . Head driving circuit, 57 . . . Heat dissipation unit, 58 . . . Temperature detection unit, 60 . . . Air blowing unit, 601 . . . First air blowing unit (example of first airflow generating unit), 602 . . . Second air blowing unit (example of second airflow generating unit), 61 . . . Duct, 62 . . . Air blowing fan, 63 . . . Air blowing port, 70 . . . Maintenance unit, 71 . . . Cap, 100 . . . Control unit, 101 . . . First cable, 102 . . . Second cable, A1 . . . Movement region, A2 . . . Ink discharging region (example of droplet discharging region), A3 . . . Maintenance region, M . . . Medium, R . . . Roll body, F . . . Transport direction, X . . . Scan direction, Y . . . Front-rear direction, Z . . . Vertical direction This application claims priority under 35 U.S.C. § 119 to Japanese Patent Application No. 2016-124229, filed Jun. 23, 2016. The entire disclosure of Japanese Patent Application No. 2016-124229 is hereby incorporated herein by reference.

The invention claimed is:

1. A droplet discharging device, comprising:

a discharging head configured to discharge a droplet toward a medium;

a head driving circuit configured to drive the discharging head;

a heat dissipation unit configured to dissipate heat generated in the head driving circuit;

a carriage configured to move in a state of supporting the discharging head, the head driving circuit, and the heat dissipation unit; and at least one airflow generating unit disposed outside a movement region of the carriage and configured to generate an airflow toward the heat dissipation unit supported by the carriage, wherein:

the movement region includes a droplet discharging region in which a droplet is discharged onto the medium, and a maintenance region for performing maintenance of the discharging head, and at least when the carriage is positioned in the maintenance region, the at least one airflow generating unit is configured to generate an airflow toward the heat dissipation unit supported by the carriage.

2. The droplet discharging device according to claim 1, wherein the at lease one airflow generating unit includes a first airflow generating unit and a second airflow generating unit, and the first airflow generating unit and the second airflow generating unit are provided along a movement region of the carriage.

3. The droplet discharging device according to claim 1, wherein the at least one airflow generating unit includes a first airflow generating unit and a second airflow generating unit, and the first airflow generating unit and the second airflow generating unit are provided along a movement region of the carriage.

4. The droplet discharging device according to claim 2, wherein the movement region includes a droplet discharging region in which a droplet is discharged onto the medium, and a maintenance region for performing maintenance of the discharging head, and when the first airflow generating unit is configured to generate an airflow toward the heat dissipation unit supported by the carriage positioned in the droplet discharging region, and when the second airflow generating unit is configured to generate an airflow toward the heat dissipation unit supported by the carriage positioned in the maintenance region, when the carriage is positioned in the maintenance region, while airflow generation from the first airflow generating unit is limited, airflow generation from the second airflow generating unit is allowed.

5. The droplet discharging device according to claim 3, wherein the movement region includes a droplet discharging region in which a droplet is discharged onto the medium, and a maintenance region for performing maintenance of the discharging head, and when the first airflow generating unit is configured to generate an airflow toward the heat dissipation unit supported by the carriage positioned in the droplet discharging region and when the second airflow generating unit is configured to generate an airflow toward the heat dissipation unit supported by the carriage positioned in the maintenance region, when the carriage is positioned in the maintenance region, while airflow generation from the first airflow generating unit is limited, airflow generation from the second airflow generating unit is allowed.

6. The droplet discharging device according to claim 1, further comprising a temperature detection unit supported by the carriage, wherein airflow generation from the at least one airflow generating unit is controlled according to a detected temperature by the temperature detection unit.

7. The droplet discharging device according to claim 1, further comprising a temperature detection unit supported by the carriage, wherein airflow generation from the at least one airflow generating unit is controlled according to a detected temperature by the temperature detection unit.

8. The droplet discharging device according to claim 2, further comprising a temperature detection unit supported by the carriage, wherein airflow generation from the first airflow generating unit and the second airflow generating unit is controlled according to a detected temperature by the temperature detection unit.

9. The droplet discharging device according to claim 3, further comprising a temperature detection unit supported by the carriage, wherein airflow generation from the first airflow generating unit and the second airflow generating unit is controlled according to a detected temperature by the temperature detection unit.

10. The droplet discharging device according to claim 4, further comprising a temperature detection unit supported by the carriage, wherein airflow generation from the first airflow generating unit and the second airflow generating unit is controlled according to a detected temperature by the temperature detection unit.

11. The droplet discharging device according to claim 5, further comprising a temperature detection unit supported by the carriage, wherein airflow generation from the first airflow generating unit and the second airflow generating unit is controlled according to a detected temperature by the temperature detection unit.

* * * * *